United States Patent [19]

Reinfeld et al.

[11] Patent Number: 4,550,549

[45] Date of Patent: Nov. 5, 1985

[54] APPARATUS AND METHOD OF PACKING ARTICLES

[76] Inventors: Nyles V. Reinfeld, P.O. Box 2321, Bath, Ohio 44210; Michael J. Valentine, 78 Tower Rd., Pines Lake, Wayne, N.J. 07470

[21] Appl. No.: 589,877

[22] Filed: Mar. 15, 1984

Related U.S. Application Data

[63] Continuation-in-part of Ser. No. 443,354, Nov. 22, 1982, abandoned, which is a continuation-in-part of Ser. No. 338,440, Jan. 11, 1982, abandoned.

[51] Int. Cl.[4] ..... B65B 43/00; B65B 35/50

[52] U.S. Cl. ..... 53/447; 53/452; 53/540; 53/561

[58] Field of Search ..... 53/452, 453, 255, 454, 53/257, 456, 260, 52, 66, 531, 561, 540, 563, 504, 447, 467, 140, 141, 242, 247, 250, 251, 390; 264/321, 45.5, 248, 53, 51

[56] References Cited

U.S. PATENT DOCUMENTS

| | | | |
|---|---|---|---|
| 797,753 | 8/1905 | Roth | 53/260 X |
| 2,638,256 | 5/1953 | Hagen et al. | 53/242 |
| 2,697,507 | 12/1954 | Vergobbi | 53/242 X |
| 3,069,725 | 12/1962 | Root | 264/248 X |
| 3,264,381 | 8/1966 | Stevens | 264/45.5 X |
| 3,299,608 | 1/1967 | Orloff et al. | 53/140 X |
| 3,456,423 | 7/1969 | Helms | 53/242 X |
| 3,466,833 | 9/1969 | Penrod et al. | 53/540 X |
| 3,478,487 | 11/1969 | Smith et al. | 53/66 |
| 3,534,525 | 10/1970 | Cleland | 53/242 X |
| 3,757,486 | 9/1973 | Feurston et al. | 53/242 X |
| 4,159,761 | 7/1979 | Egee et al. | 53/540 X |
| 4,309,861 | 1/1982 | Karpisek | 53/390 X |

*Primary Examiner*—Horace M. Culver

*Attorney, Agent, or Firm*—Oldham, Oldham & Weber Co.

[57] ABSTRACT

A method of packing articles including positioning an article retainer around a temporary article support and placing articles on such temporary support within the retainer, measuring the height of the articles in the retainer and automatically forming a container of enclosure of a size to enclose the articles. Thereafter the formed container is suitably positioned around the articles and container top is put on the container end to close the container and complete the packaging operation.

18 Claims, 21 Drawing Figures

APPARATUS AND METHOD OF PACKING ARTICLES

CROSS REFERENCE

This application is a continuation-in-part of my prior application Ser. No. 443,354, filed Nov. 22, 1982 and now abandoned, which was a continuation in part of application Ser. No. 338,440, filed Jan. 11, 1982 and now abandoned.

TECHNICAL FIELD

This invention relates to an article packaging method using automated or semiautomated steps; which method avoids the stocking of any preformed packaging blanks, cartons, containers or boxes.

BACKGROUND ART

Heretofore, in most article packaging operations, a plurality of manual operations have been required and usually the articles to be packaged will vary widely in number, weight and volume so that in businesses that ship a variety of products, a plurality of different sizes of preformed shipping containers are required. This number of different shipping containers can be extremely large when a variety of packages and articles are being shipped, and a large inventory of different size boxes, containers or container blanks is required and the particular shipper enclosure is manually selected for size and than has the articles to be shipped manually placed therein. Furthermore, an appreciable amount of storage space is required for the large number of packaging units, shipping containers or boxes that must be stored and appreciable inventory costs are incurred in these prior packaging operations.

Manual operations of a repetitive nature in packaging operations can be quite costly as well as being tedious to perform. Hence, any automation that can be provided in packaging actions is quite desirable while any reduction in inventory costs and storage space provides savings of packaging costs.

DISCLOSURE OF THE INVENTION

It is an object of the invention to provide a packaging operation that is at least semi-automatic or automated in operation and which uses no preformed packages, containers, boxes or similar items; and that will replace use of prepurchased cartons.

The main object of the invention is to mold a shipper to the size of the product to be shipped, even if each product in the sequence is of a different size; and then automatically to encase the product in the shipper, whereas the existing present method of packaging is to pre-purchase a variety of cartons to fit the products to be shipped, to store them, and to draw them from stock as they are needed.

Another object of the invention is to provide a conceptual invention on a packaging method and apparatus by which the shipper container will be formed sized to receive the product to be shipped and will thus be indeterminate in size until the order is actually ready for shipping, and to avoid any use of a packaging system wherein each carton or shipper container is preformed and is of a fixed size for the goods to be assembled in the carton to be shipped therein.

Another object of the invention is to utilize packaging containers that can be formed concurrently with the packaging units as they are formed to correspond in size to the size and volume of the package unit and to ship articles in newly formed containers of uniform cross-section but of different lengths.

Another object of the invention is to use plastic, such as styrofoam, for making shipping containers to reduce the cost of shipping the container and to reduce the weight of the shipped package.

An object of the invention is to provide a new packaging system that avoids storage of packaging containers and reduces the costs for article packaging by automating packaging actions.

A further object is to provide a system that will immediately on demand automatically produce a molded plastic shipper of the proper size needed and automatically encapsulate articles to be shipped within the shipped article just produced.

The process may involve stacking various articles in a packing fixture, measuring the height of the stack, automatically forming an elongate container of a size to receive the stack, and positioning the container around the stack; and it may include mechanically and/or manually processing grouped articles to position them in an enclosed container ready for shipment; and its object is to improve and automate packaging actions.

These and other objects and advantages of the present invention will become more apparent as the specification proceeds and they are achieved by forming attic les into a stack, measuring the height of the stack, forming a container of a size to receive the articles as stacked therein, and utilizing said container to enclose said articles.

Under the present method of distribution, whether it is manufacturing of a given product, or catalog business, a pre-determined size of carton (shipper) is purchased to fit the product.

Under the new system, the shipper (known as the old carton that we pre-purchase today), is produced around the product manufactured, or to be distributed, rather than purchased to fit the product. This is the concept—an entirely different system of distribution.

BRIEF DESCRIPTION OF THE DRAWINGS

Reference now is made to the accompanying drawings, wherein.

BEST MODE FOR CARRYING OUT THE INVENTION

Figure 2:
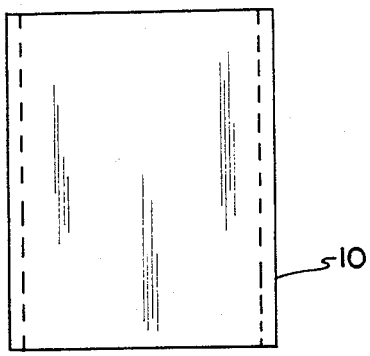
FIG. 2 is a plan view of the pallet of FIG. 1.
Figure 1:
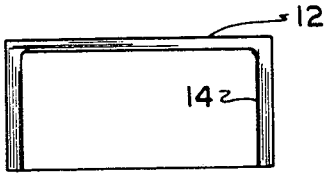
FIG. 1 is a front elevation of a pallet used in practice of the new packaging method.
Figure 3:
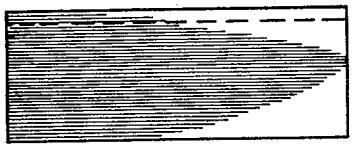
FIG. 3 is a side view of the pallet of FIG. 1.

With particular reference to the details of the structure shown in the accompanying drawings, a support pallet 10 is shown in FIGS. 1 through 3 and this support pallet comprises a generally inverted, U-shape in vertical section structure that has open ends and which is adapted to receive articles to be packaged on a top surface 12 of the pallet. The support or pallets 10 can be made from plastic of any conventional nature and it has opposed open ends 14. The pallet is adapted to have a retainer 20 positioned around it to aid in retaining articles thereon. This retainer 20 comprises an open ended box-like structure that has a pair of opposed sides 22 and 24 and opposed ends 25 in which a vertically extending slot 26 is formed. This slot 26 extends downwardly of the retainer from the top edge thereof and it terminates in an enlarged base slot 28. The retainer 20 will fit snugly around the pallet 10 as indicated in the drawings.

Figure 4:
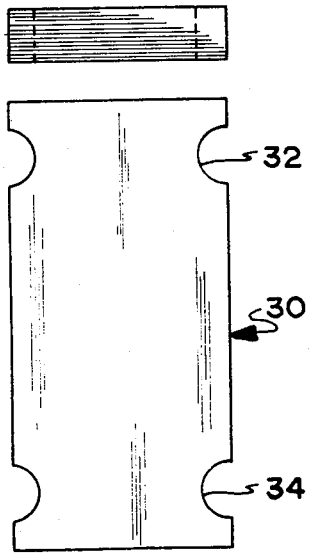
FIG. 4 is a diagrammatic plan view of a support fork or plate used in practice of the invention.
Figure 5:
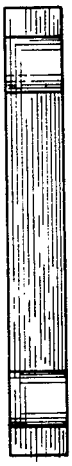
FIG. 5 is a side view of the support plate of FIG. 4.
Figure 6:
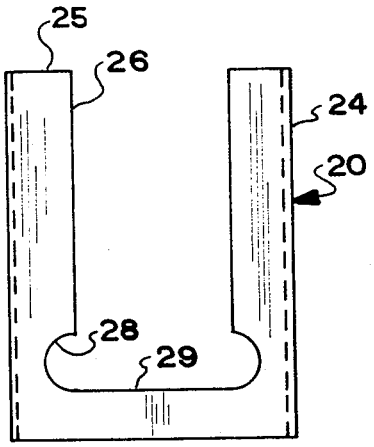
FIG. 6 is an end view of a retainer used in the packaging method of the invention.
Figure 7:
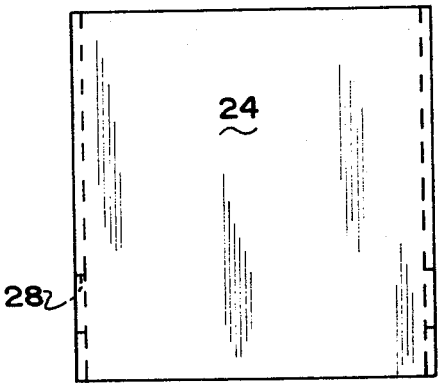
FIG. 7 is a side elevation of the retainer of FIG. 6.
Figure 15:
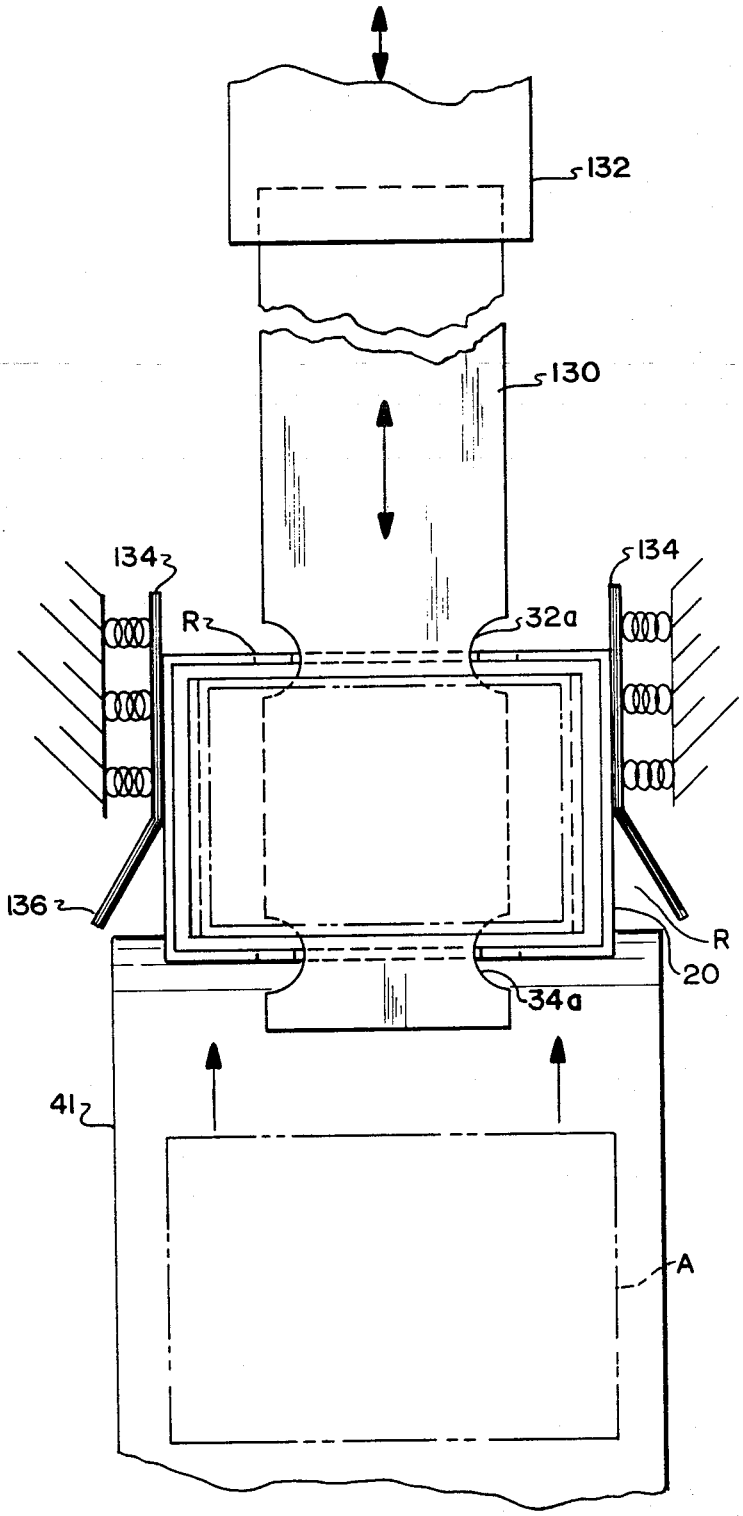
FIG. 15 is a plan view with more details being shown thereon of the assembly of the retainer and articles as being moved onto the support pallet is generally indicated in FIG. 10.

A support fork or plate 130 is formed as diagrammatically shown in FIGS. 4 and 5 and is shown more completely in FIG. 15. This support plate or fork 130 has pairs of opposed edge recesses 32*a* and 34*a* formed therein adjacent opposite ends thereof. The plate or support fork 130 is of a size that the opposed slots 32*a* and 34*a* can be received in and slid through between the edges of the vertically extending slots 26 in the retainer so that the plate can be moved vertically with relation to the retainer through the open slots therein when the recesses 32*a* and 34*a* are engaged with the slots 26. A bottom surface 29 of the base slot 28 is below the horizontal support surface 12 of the pallet 10 when the pallet and retainer are on a common support.

Figure 8:
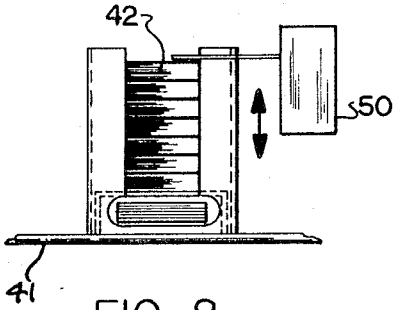
FIG. 8 is a diagrammatic view of an assembly of the pallet and retainer moving through a fixed course with a plurality of packaged articles therein and wherein the height of the packaged articles is being measured.

It also is possible to assemble the pallet 10, retainer 20, and articles in an assembly A on a conveyor 41 and move the assembly through a fixed course. In all events, the assembly A is moved by the conveyor 41 with the articles, books 42, stacked thereon. Next, any known type of a height sensing device indicated at 50 can be brought into association with the articles positioned within the retainer 20 to measure the height thereof. This height measurement which can have a suitable electrical control output or other indicator is then transmitted to a control station 70, FIG. 9, for the package producing apparatus or mold and where an adjustable length mold 60 is present. The mold's length is adjusted automatically or manually to the height of the articles received within the retainer 20 in the assembly A. Then a particular container is formed to proper length for receiving the stack of books or articles 42 within the retainer 20, FIG. 8. The mold cavity length is varied by moving a mold shell 62 axially of a fixed mold core 64. The mold end 66 is separately movable and is brought to mold closing position for all molding cycles by a known type of control. The container 52 then produced is removed from the mold as by air pressure introduced into the vented core 64 and is next moved to a special support station partially indicated at FIGS. 10 and 15 in the drawings.

Next, as the packaging assembly is moved along its fixed course, the assembly is slid or telescoped onto a modified plate, support member or fork 130 which is positioned to have a free end extending towards the conveyor axis. At this area, the conveyor is changing its course and starts to move down around a support drum. Such fork 130 is positioned to extend underneath the horizontal surface of the pallet 12 through its open ends and through the bottom slots 28 of the retainer 20. The recesses 32*a* and 34*a* will then still permit relative movement of the retainer 20 in relation to the support member or fork 130 as these recesses 32 and 34 can slide up through the vertical slot 26 in the retainer and permit disengagement of the retainer from the pallet and fork unit. Also, any articles on the pallet (and extending vertically upwardly therefrom) can be retained in alignment.

The book assembly A, by relative movement of the conveyor 41 in relation to the support plate 130 impinges onto the support plate or fork 130 but the support fork may also be moved longitudinally to slide in under the pallet 10.

Figure 16:
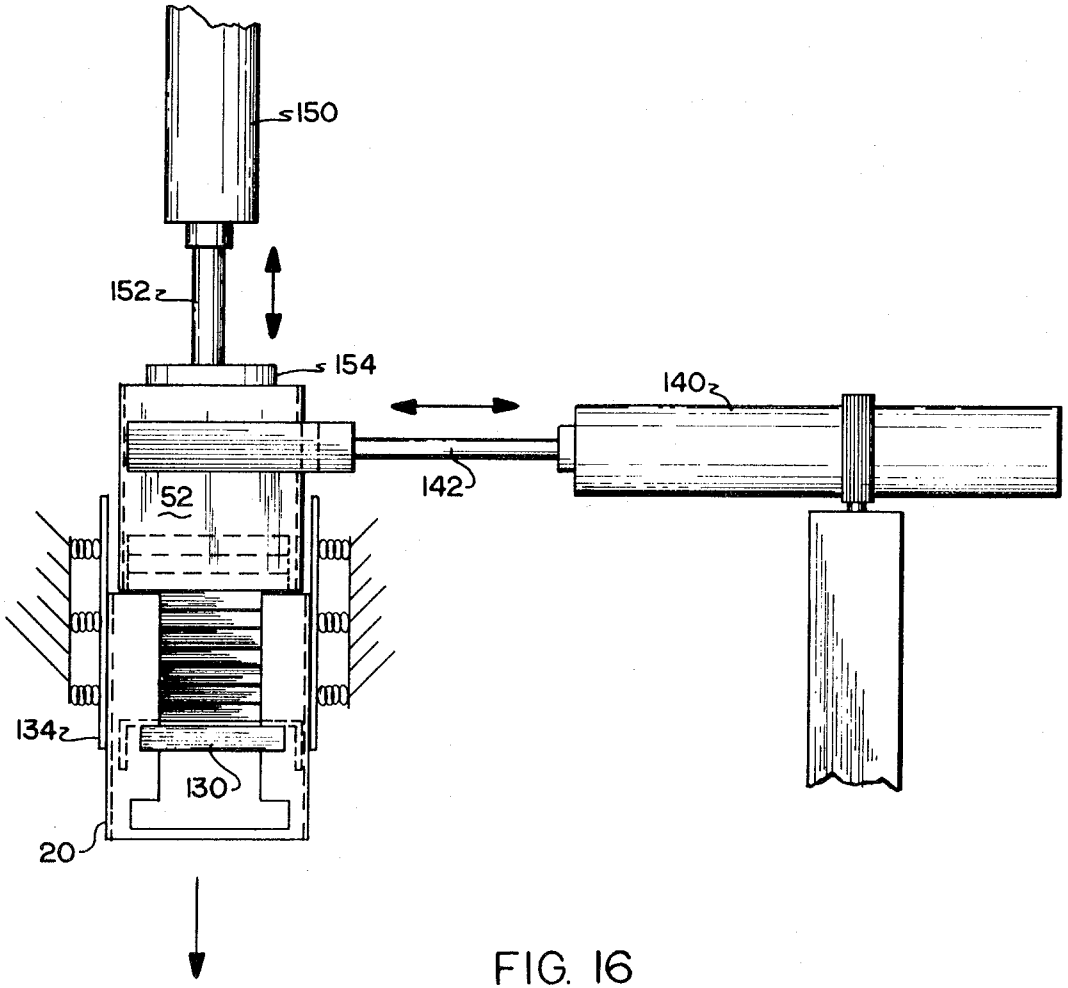
FIG. 16 is a diagrammatic view of more detail shown thereon of the apparatus as indicated in FIG. 10 for positioning a container on the stacked articles on a pallet.

The retainer removing station may comprise, as partly shown in FIGS. 15 and 16, the provision of a support clamp or other member 132 for engaging one end of the support plate 130, as indicated. The clamp or device 132 has suitable means (not shown) engaged with it to reciprocate the member 132 and the support fork 130 on its longitudinal axis.

The assembly A is centered on the support plate 130 by resiliently positioned guide plates 134 with outwardly flared edges 136 so that the retainer 20 is resiliently engaged by the guide plates 134. However, while on this support plate 130, the retainer can be readily removed by a downwardly directed force applied thereto. This may be provided as by the use of the container 52, which has an initially open lower end, and is telescoped over the stack of articles on the pallet and is adapted to engage the upper end of the retainer. The container can be moved manually or otherwise vertically downwardly as by a piston 150 from a control cylinder 152 as later described, to force the retainer from association with the other articles as this only requires that the support plate 130 have its recesses 32*a* and 34*a* move up through the vertically extending slots 26 in the retainer. Thereafter the entire container, articles and pallet unit is positioned on the support plate 130. Now the articles and the container 52 can be retained against axial movement on the support by a retractable pressure piston 56, FIG. 12, that is operatively moved into engagement with the container and retains it against such movement. At the same time, a pusher arm or bar 138, operated by a known means, moves in from the opposite end of the container 52 and engaged, for example, with just the support lower edges of the pallet's sides that extend below the support plate 130. The pusher can move such pallet longitudinally along the support plate 130 to force it out of operative association with the stack of books, container and the support plate. This causes the articles in the container to drop down to be resting on the support plate 130 as shown in FIG. 13, after which the open end of the container can be closed.

Figure 14:
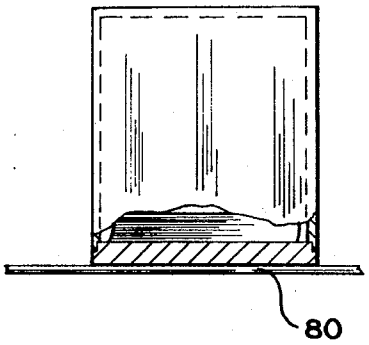
FIG. 14 is a fragmentary vertical section, diagrammatic, showing the assembly of the closure on the container and packaged particles.
Figure 11:
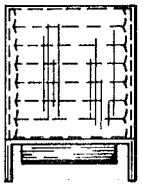
FIG. 11 is a diagrammatic view showing the assembly of the container and articles as positioned on a support pallet and fork.
Figure 13:
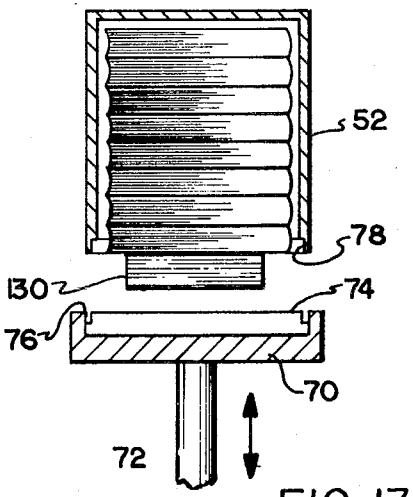
FIG. 13 is a diagrammatic view showing the step of placing a closure on the open bottom end of the container in the packaging method.

Thus, FIGS. 13 and 14 of the drawings indicate that a top 74 for the container is provided, and it is moved in under the support plate. Next the positioning means for the clamp 132 are actuated to move the support plate 130 back on its longitudinal axis and strip the container and books from the support plate via a stop bar like the bar 56 engaging the side of the container adjacent the clamp 132. Thus, the container and books assembly is prevented from moving axially on the support plate 130 by the stop or retractable arm provided.

The retraction action on the support plate 130 is provided when a bottom cover or top 74 for the container is adapted to be positioned on the open lower end of this container 52. Thus, FIG. 13 shows that a retractable carrier plate 70 is positioned by a suitable support piston arm 72 or the like whereby such carrier plate can be reciprocated vertically upwardly and downwardly in relation to the support plate 130. Thus, the carrier plate 70 with the top or cover 74 for the container 52 being positioned, for example, in a recess in the top of the carrier plate 70 is brought up immediately below the assembly of the container and books whereby when the support plate 130 is moved out from and under the books-container assembly, they will just drop downwardly and will bear upon the upper surface of the top 74. This top 74 preferably has a recessed or shouldered outer edge 76 adapted to engage with a complementary shaped shoulder 78 formed on the lower end of the container. Thus, an accurate alignment can be obtained between the container and its top and attachment of the container top to the container is facilitated since any suitable adhesive means can be suitably positioned on the shoulder 76 on the top prior to its engagement with the open lower end of the container. Then the completed container assembly can be suitably moved, slid, or manually changed over from being positioned on the carrier plate 70 over to being on any type of discharge conveyor 80 or other equivalent means as generally indicated in FIG. 14 of the drawings for further processing or movement through the packaging assembly, as desired. Thus suitable labelling means or other packaging operations can be performed on the now completely closed container 52 having the packaging articles or articles to be shipped present therein.

It will be realized that the apparatus and method steps shown herein are examples only and that various other types of apparatus or means can be used for performing the various method steps as described herein.

Figure 9:
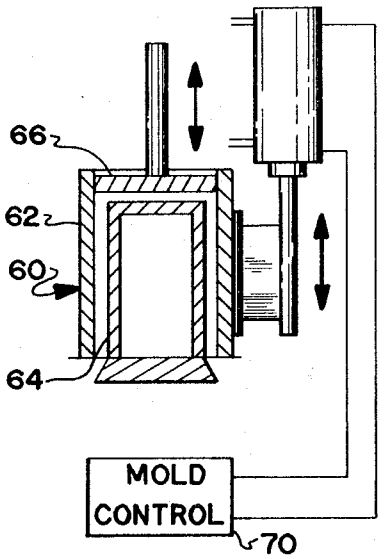
FIG. 9 is a diagrammatic view of an adjustable length mold for forming containers for use in the method of the invention.
Figure 10:
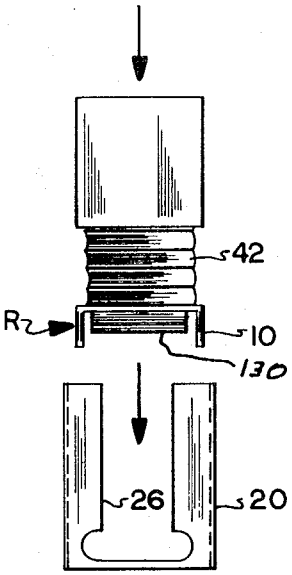
FIG. 10 is a diagrammatic view of apparatus for separating the retainer from the stack of articles as in FIG. 8 and wherein a container is added to the assembly.
Figure 17:
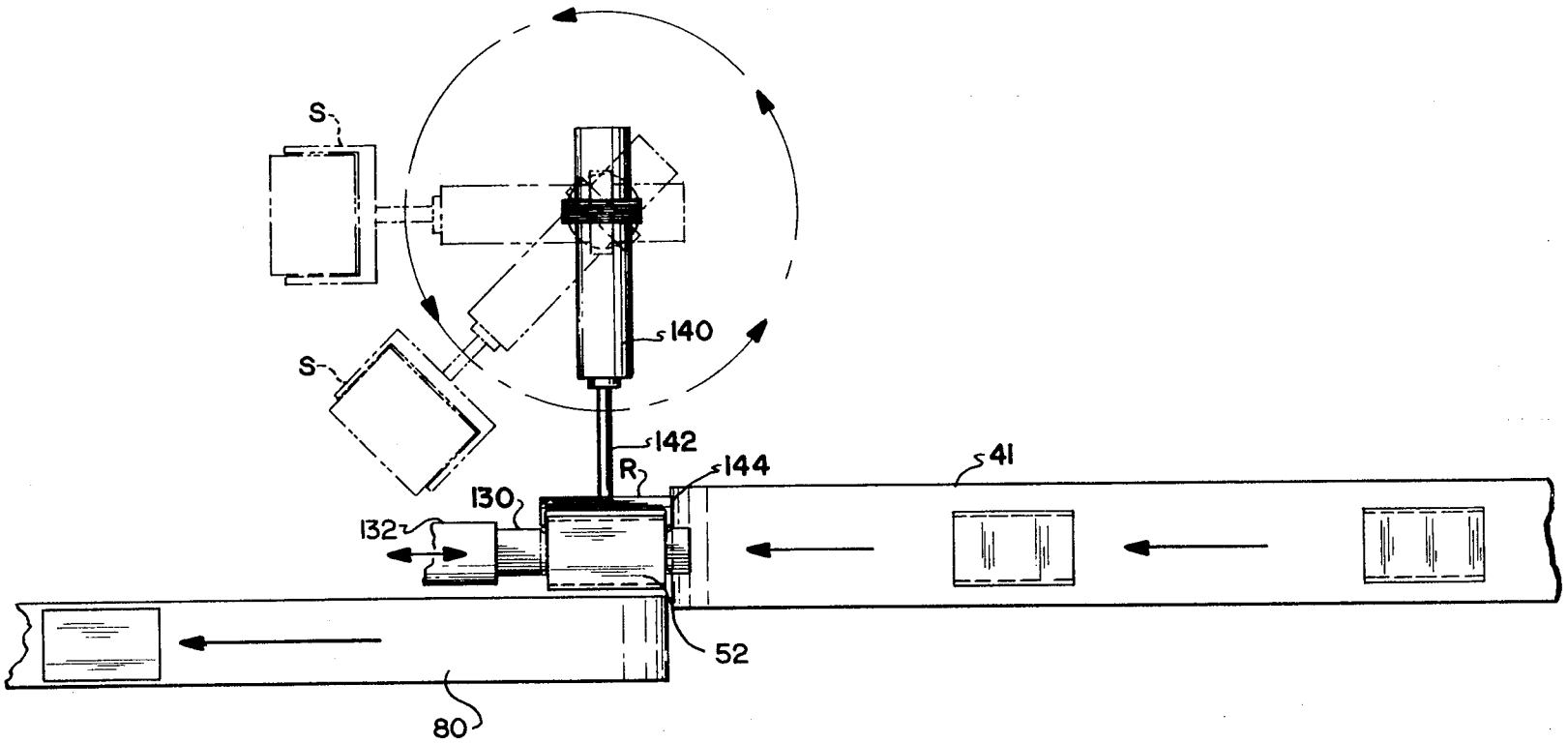
FIG. 17 is a plan view showing more details thereon of the apparatus used in association with the steps of FIG. 10 and wherein containers are moved into vertical alignment with the apparatus as indicated in FIG. 16.

Some other details of the apparatus of the invention are partially shown in FIGS. 16 and 17. Thus, FIG. 17 shows that there can be a plurality of container forming stations indicated at S in FIG. 17. Each of these container forming stations could have a molding apparatus as diagrammatically shown in FIG. 9 provided therein and a pivotally positioned control cylinder 140 is positioned adjacent these container forming stations S and designed to have a control piston rod 142 that can swing around in a horizontal plane. Clamping means 144 that are operatively positioned on the end of the piston arm 142 can be actuated to engage with a container provided at one of these container producing stations S. These clamp means (not shown) can be of any suitable type and be mounted, if desired, on the end plate engaging the piston rod 142 as roughly shown in FIG. 17. Then the control cylinder 140 can be manually or otherwise moved through an arc from the package producing station S over to the retainer removing station R as shown in FIG. 17. This retainer removing station, FIG. 16, has the suitably positioned control cylinder 150 positioned vertically above this support plate 130 and in line with the resilient side plates 134 and operative portion of the support plate 130 between the recesses **32*a* and 34*a*. Thus, the control cylinder 150 has a piston rod 152 extending therefrom and ending in a pressure plate 154. When the control cylinder 150 is actuated, its pressure plate 154 will engage with the upper end of the container 52 and this container engages directly with the upper end of the retainer 20 so as to force it to move resiliently downwardly between the pressure plates 134 holding the retainer in the packaging assembly. The clamp members 144 are, of course, released prior to any movement of the container downwardly and this release will occur when the container has been aligned vertically with the retainer and articles assembly, or clamps 144 may be loose enough to enable downward movement of the container. Any suitable guides, as required, can be positioned in association with the retainer and book assembly A when positioned at the station shown in FIG. 15 to enable the container to readily engage therewith and remain in vertical alignment therewith when pushed downwardly by the control cylinder 150**.

Note that the retainer 20 is resiliently supported at the retainer removing station R by the pressure plates 134.

Figure 12:
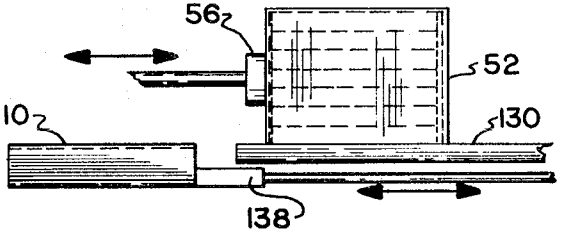
FIG. 12 is a diagrammatic view showing removal of the pallet from the assembly of the pallet, support fork, container and articles.

Of course, the pusher arm 138, FIG. 12, can engage the pallet 10 or its sides in any desired manner to push the pallet clear of the container-article assembly. The container 52 is slightly longer, usually, than the stack of articles to be packaged, as shown in FIG. 13. This enables the end closure 74 to be affixed to the container, as stated.

It further should be understood that while diagrammatic apparatus has been indicated as performing a number of steps in the method of the present invention, a number of these operations can be performed manually or be controlled manually, or semi-automatically or automatically as desired. It also is possible to mount the support means for the support plate 130 to be moved around on a turret type of assembly control cylinder 140. Thus, a plurality of stations could be provided for the various clamp means 132 supporting the support shelves or plates so that a number of different operations could be performed somewhat simultaneously as the different support shelves would be moved through arcs from one operative station to another while the general operations shown in FIGS. 10 through 14 are performed on the container or package assembly.

It also should be noted that the articles to be shipped could be manually assembled into a shipping group, which preferably would be of a cross-section substantially the same as for other shipping groups, the length of the group would be manually measured or observed, and the mold would be set to produce a shipping container of the length to encapsulate the group of the articles to be shipped. Then the shipping container would be produced in the mold apparatus of FIGS. 18 to 21 and the container may be varied in more than one dimension. The container produced could then be manually placed around the group of articles prepared for shipping, the open end of such container would have cover applied thereto and the container would be ready for shipping.

The more automation provided for the shipping system, the more the costs of the packaging operation will be reduced, but any step would be done manually. Still storage of any preformed shipping container is avoided.

Use of a light weight plastic (styrofoam or styrofoam beads) for the container will reduce in packaging operations as desired.

Figures 18, 19, 20, 21:
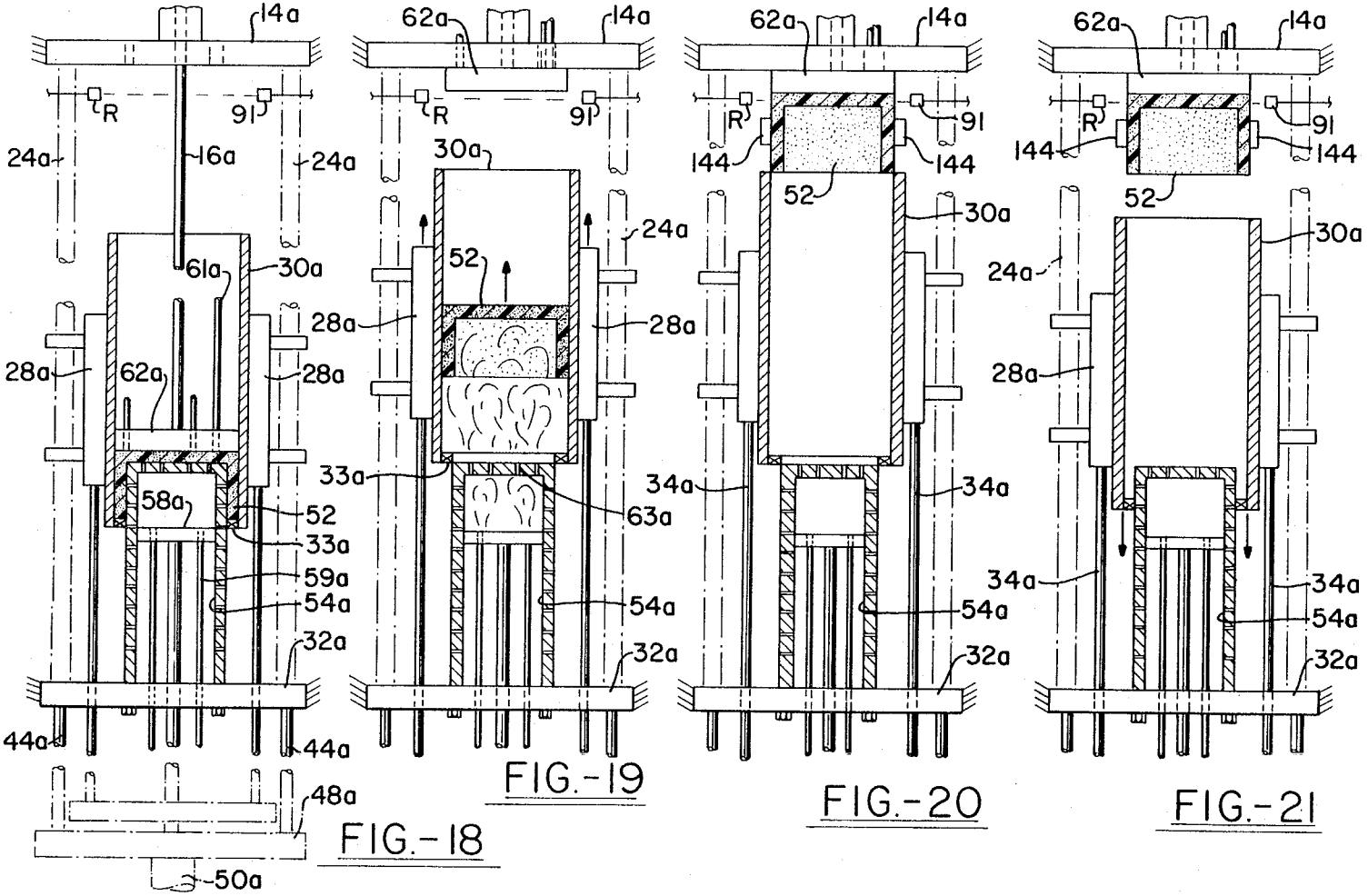
FIGS. 18 through 21 show the container molding apparatus as it forms a container and the steps of discharge of the same.

More details of the adjustable length mold, shown diagrammatically in FIG. 9, are shown in FIGS. 18 to 21. Here a mold frame 14*a* has fixed plates 32*a* and 48*a* on frame rods 34*a*. A mold core 50*a* is secured to the platen 32*a* while a slide carriage means 28*a* positions a mold shell 30*a* on the frame rods 34*a*. The mold shell has a bottom ring 33*a* thereon and it closes the lower end of a mold cavity that the mold shell defines around the mold core. By moving the mold shell 30*a* axially, the length of the mold cavity is varied. An upper mold end plate 62*a* closes the upper end of the mold cavity and it is separately movable vertically by a suitable member as a cylinder while a mold core bottom plate 58*a* is slidably positioned within the mold core 50*a* and is movable therein by any desired controls. The bottom plate 58*a* may move with the mold shell or separately therefrom but normally would be operatively positioned slightly below horizontal alignment with the lower end of the mold shell 30*a* when it is set up for a molding action, as shown in FIG. 18.

The mold cavity would be filled, for example, with polystyrene beads supplied by means connecting to a suitable supply line 61*a* secured to and extending through the top plate 62*a*. The beads would be pre-expanded and would be set up or formed into a container unit 52*a* by steam supplied to the bottom plate 58*a* by a steam line 59*a*. Suitable vents 63*a* are formed in the mold core to pass steam and fluids therethrough but which prevent passage of the plastic beads.

The end plates 62*a* and 58*a*, mold core 50*a* and mold shell 30*a*, are sealed in relation to each other but the parts permit some leakage of fluids therebetween. The container 52*a* is formed to the size and length of the mold cavity and then is cooled as by water and or air supplied to the bottom plate 58*a* and released into the mold core 50*a*.

Then to remove a container from the mold cavity, it first is necessary to move the top mold plate 62*a* to an upper most position and then mold shell 30*a* is raised vertically. This causes vertical movement of the mold closure ring 33*a* that in turn would move the molded container 52*a* (or start to move the mold container) up with it. At the same time, an air pressure blast or supply is provided to the mold cavity bottom plate 58*a* so that air pressure going through the apertures or vents 63*a* in the mold core will aid in separating the molded container from the mold core and facilitate vertical movement of the container 52*a*. This air pressure will cause the container 100 to move axially of the mold shell 30*a* and its movement usually is terminated by upper mold plate 62. At that portion of the molding press apparatus, a sensor means is provided such as a photo electric eye indicated at R and a beam producing means a, so when the beam is interrupted by a container being moved up vertically from the mold shell 30*a*, then this can provide a control function. Such function may include activating the pair of clamp arms 144 to be moved to engage the container 52. Then the mold shell 30*a* can be moved down, FIG. 21, after which the container can be rotated with the control cylinder 140 as shown in FIG. 17 to bring this container into alignment with the articles carried by the retainer 20 as shown in FIG. 16. Prior to the container being moved away from its molding area, the mold shell 30*a* has been moved downwardly to fully release the container and permit lateral movement thereof with the clamp members engaging the same.

For a new molding cycle, the mold shell 30*a* is telescoped over the mold core to provide the desired length cavity and then the top plate 62*a* is lowered to close the cavity upper end. The bottom plate 58*a*, if not so positioned before, is moved to operative relation with the mold core and mold shell and beads are carried by an air stream or gravity into the mold cavity to fill the same under slight pressure. The beads then are heated by the injected steam flow to produce porous container. The end plate 62*a* can be moved in slightly before the mold heating if required.

While several embodiments of the invention have been disclosed herein, it will be appreciated that modification of these particular embodiments of the invention may be resorted to without departing from the scope of the invention.

What is claimed is:

1. A method of packing articles in a container comprising the steps of:

forming articles into stacks of different heights but of substantially constant cross-sectional shape and area in a temporary retainer, measuring the heights of the stack of articles, after measuring the height of the stacks, molding an open-ended container of a length to receive said articles as stacked, and telescoping said newly molded container over said articles to enclose the same.

2. A method of packing articles as in claim 1, including the articles being moved through a fixed path, when in the temporary retainer, and forcing the retainer downwardly out of engagement with the articles by telescoping of the newly made container downwardly over the stacked articles.

3. A method of packing articles as in claim 1, including moving the articles along a fixed path, when in the temporary retainer; stopping movement of the articles and temporary retainer; and thereafter forcing the retainer downwardly out of engagement with the articles by telescoping the newly made container downwardly over the stacked articles.

4. A method of packing articles in containers having a constant cross-section but varied length where a temporary support for the articles is utilized, comprising the steps of:

placing articles on the temporary support;

measuring the heights of articles in the support;

after measuring the height of the stacks, molding a container with one open end and of a length and size as to receive said articles therein;

moving the newly formed container into axial alignment with but above the articles in the support, the open end of the container being at its lower end, and forcing the container down over the articles; and moving the temporary support out of engagement with the articles.

5. A method of packing articles in containers as in claim 4 comprising the steps of:

positioning an article retainer around the temporary support;

placing the articles on the temporary support and within the retainer to form an assembly of the support, articles and retainer; and inserting a support plate means into the assembly to support such assembly thereto; and wherein the support plate means and retainer are adapted to enable the retainer to be forced downwardly out of engagement with the support and articles by engaging the container with the same.

6. A method of packing articles in containers as in claim 5, where a lid is positioned adjacent the open end of the container and relative movement of the support plate means and container bring the container and lid into operative engagement.

7. A method of packing articles as in claim 6 including removing the temporary support from association with the articles prior to engaging the lid with the container.

8. A method of packing articles in containers as in claim 5, where the article retainer has a pair of vertically extending opposed slots formed in opposed sides thereof and extending downwardly from upper sides edges thereof and said temporary support has a pair of opposed open sides, portions of said slots being aligned with said open sides in the assembly of the support, articles and retainer, and stabbing said support plate means through said slots and open sides to engage said temporary support.

9. A method of packing articles as in claim 6, including removing the temporary support from association with the articles by pushing the temporary support laterally while preventing lateral movement of the articles to drop the stacked articles down onto the support plate means and thereafter removing the support plate means.

10. A method of packing articles in containers as in claim 4 where the container is molded in an adjustable length mold having a removable closure at one end of the mold cavity and a hollow mold shell enclosing a mold core to define the length of the mold cavity and characterized by the molded container being forced axially of the mold shell by fluid pressure to protrude out of one end of the mold shell, and engaging the container by a transfer means prior to its release from the mold shell.

11. Apparatus for use in packing articles comprising:

a pallet of generally inverted U-shape in vertical section and being adapted to support articles thereon;

a box-like retainer that has open ends and slots extending downwardly thereof from its upper end in a pair of opposed sides and terminating in an enlarged bottom slot at the lower ends of the opposed sides;

said retainer aiding in aligning and retaining articles on said pallet and being positionable therearound; and a support plate means engageable with said retainer in said bottom slots to extend through said retainer.

12. Apparatus as in claim 11, where said support plate means has a pair of opposed edge slots therein at spaced portions thereof, said support plate means being movable vertically relative to said retainer when its edge slots are received in side slots of said retainer to enable said retainer to be separated from said pallet.

13. Apparatus as in claim 12, where said retainer closely encompasses said pallet which is movable axially through said retainer, an end of said support plate means being extended from said retainer and pallet assembly and adapted to engage means for supporting said pallet and any articles thereon.

14. Apparatus for use in packing articles as in claim 11, where said support plate means is positionable under a top portion of said pallet to support said pallet, and has end portions extending beyond said pallet and said retainer; and said retainer being of a size to slid down over said pallet when operatively engaged therewith.

15. Apparatus for use in packing articles comprising:

a pallet of generally inverted U-shape in vertical section and being adapted to support articles thereon;

a box-like retainer that has open ends and slots extending downwardly thereof from its upper end in a pair of opposed sides and terminating spaced from the lower ends of the opposed sides;

said retainer aiding in aligning and retaining articles on said pallet and being positionable therearound to extend upwardly therefrom when said pallet and retainer are positioned on a common support; and a support plate means engageable under said pallet and of a size to extend through said slots in said retainer and protrude therefrom on at least one side.

16. Apparatus for use in packing articles as in claim 14 and where said support plate means supports said pallet and extends from said retainer in at least one direction, said retainer being adapted to be moved downwardly of said support plate means to disengage from said pallet and articles thereon.

17. A method of packing articles in containers having a constant cross-section but varied length where a temporary support and an article retainer for the articles are utilized, comprising the steps of:

positioning an article retainer around the temporary support;

moving the temporary support and article retainer through a fixed path by a moving conveyor;

placing articles within the retainer and on the temporary support to stack articles therein and form an assembly of the support, articles and retainer; the article retainer having a pair of vertically extending opposed slots formed in opposed sides thereof and said temporary support has a pair of opposed open sides, portions of said slots being aligned with said open sides in the assembly of the temporary support, articles and retainer; stabbing a support plate means through said slots and open sides to engage said temporary support, removing said temporary support from said conveyor to position said temporary support on said support plate means;

measuring the height of the article stacks and molding a container having an open end and being of a length to receive said stacked articles;

moving the newly formed container which has an open lower end and is of a length and size as to receive said articles therein into axial alignment with but above the temporary support; and forcing the container down over the articles to simultaneously move the article retainer out of engagement with the articles while said support plate means supports said temporary support.

18. A method of packing articles as in claim 17 and including sliding the temporary support out of engagement with the container and articles to drop them onto said support plate means;

moving a top cover for the container to a position adjacent but below said support plate means, and sliding said container with the articles therein off said support plate means to drop the open lower end of the container onto said top cover for ultimate closure of said container to enclose the articles.

* * * * *